US008083866B2

(12) United States Patent
Baudis et al.

(10) Patent No.: US 8,083,866 B2
(45) Date of Patent: Dec. 27, 2011

(54) METHOD FOR HARDENING THE SURFACES OF WORK PIECES MADE OF STAINLESS STEEL, AND A MOLTEN SALT BATH FOR REALIZING THE METHOD

(75) Inventors: Ulrich Baudis, Alzenau (DE); Michael Merz, Mannheim (DE)

(73) Assignee: Durferrit GmbH, Mannheim (DE)

( * ) Notice: Subject to any disclaimer, the term of this patent is extended or adjusted under 35 U.S.C. 154(b) by 503 days.

(21) Appl. No.: 12/262,960

(22) Filed: Oct. 31, 2008

(65) Prior Publication Data

US 2010/0108198 A1 May 6, 2010

(30) Foreign Application Priority Data

Oct. 31, 2007 (DE) ..... 10 2007 051 949

(51) Int. Cl.
*C23C 22/70* (2006.01)

(52) U.S. Cl. ..... 148/242

(58) Field of Classification Search ..... 148/22, 148/242

See application file for complete search history.

(56) References Cited

U.S. PATENT DOCUMENTS

| | | | | |
|---|---|---|---|---|
| 2,249,581 | A | 7/1941 | Solakian | |
| 2,537,830 | A * | 1/1951 | Holden | 148/631 |
| 3,840,450 | A | 10/1974 | Inoue | |
| 4,461,655 | A | 7/1984 | Kerridge | |

FOREIGN PATENT DOCUMENTS

| | | | |
|---|---|---|---|
| DE | 10 2006 026883 | B3 | 8/2007 |
| EP | 0 054 962 | A1 | 6/1982 |

OTHER PUBLICATIONS

"Kolsterisieren®, Korrosionefestes Oberflächenhärten von austenitischem, rostfreiem Stahl". Informationsblatt der Bodycote Hardiff bv, Parimariboweg 45, NL-7333 Apeldoorn. info@hardiff.de. [Klosterizing® Corrosion-Resistant Surface Hardening of Austentic, Non-Rusting Steel].

Spies, H.-J. et al., "Structure and properties of stainless steels after plasma immersion ion implantation and plasma nitriding", *Mat.-wiss. u. Werkstofftech*,1999, pp. 457-464, 30, Wiley-VCH Verlag GmbH.

"Stahl Merkblatt 821; Edelstrahl Rostfrei-Eigenschaften", *Informationsstelle Edelstahl Rostfrei PF 102205*, 40013 Dusseldorf, www.edelstahl-rostfrei.de. [Steel Leaflet 821; Non-Rusting Characteristics of Stainless Steel].

Guenther, F. et al., "Surface hardening of austenitic steels under maintenance (preservation) of the corrosion resistance by low pressure and plasma caburizing", *Haerterei-Techn. Mitt.*, 2000, pp. 74-84, 56.

Van Der Jagt, R.H., "Kolsterising-Surface Hardening of Austenitic and Duplex Stainless Steels without Loss of Corrosion Resistance", *Heat Treatment of Metals*, 2000, pp. 62-65, 3.

Sun, Y., Bell, T. (1999). The Response of Austenitic Stainless Steels to Low-Temperature Plasma Nitriding. *Heat Treatment of Metals*, pp. 9-16 (1999).

Alwart et al., "Low-temperature nitrocarburizing", Advanced Materials & Processes, American Society for Metals Metals Park, Ohio, vol. 154, No. 3., pp. 41-43, 1998.

Baudis et al., "English and Translated title" [Analyses for understanding the chemical reactions during the nitrocarburizing in molten salt], HTM Haerterei, Technical Information, Publishing vol. 58, No. 5, pp. 251-256, 2003.

European Search Report issued in EP Application No. 08 018 519. 2-2122 dated Dec. 16, 2010.

European Office Action issued in EP Application No. 08 01 8519 dated Dec. 16, 2010.

* cited by examiner

*Primary Examiner* — Jessee R. Roe

(74) *Attorney, Agent, or Firm* — Venable LLP; Robert Kinberg; Leigh D. Thelen

(57) ABSTRACT

A method for hardening the surfaces of work pieces made from stainless steel includes submerging the work pieces into a molten salt bath having the composition: potassium acetate 60-100 weight %; sodium acetate 0-100 weight %; metal salt 0-2 weight %, and are subjecting the work pieces to the molten salt bath for a period of 24 to 240 hours, during which the temperature of the molten salt bath is maintained less than 400° C.

11 Claims, 2 Drawing Sheets
(2 of 2 Drawing Sheet(s) Filed in Color)

METHOD FOR HARDENING THE SURFACES OF WORK PIECES MADE OF STAINLESS STEEL, AND A MOLTEN SALT BATH FOR REALIZING THE METHOD

CROSS-REFERENCE TO RELATED APPLICATION

This application claims the priority of the German Patent Application DE 10 2007 051 949.6, filed on Oct. 31, 2007, the subject matter of which is incorporated herein by reference.

BACKGROUND OF THE INVENTION

The present invention relates to a method for hardening the surfaces of work pieces made of stainless steel, as well as to a molten salt bath for realizing this method.

As a result of its excellent corrosion resistance, stainless steel is used for chemical apparatuses, in food technology, in the petro-chemical industry, in offshore areas, for the construction of ships and airplanes, in the field of architecture, for home construction and equipment manufacturing, as well as in many other areas of industry.

Stainless steel is considered to be corrosion-resistant if at least 13 weight % of chromium is added by alloying to an iron material. In most cases the iron alloy also contains nickel, titanium and molybdenum, for example as described in *Stahl Merkblatt* 821 "Edelstahl Rostfrei—Eigenschaften Informationsstelle Edelstahl," PF 102205, 40013 Düsseldorf www.edelstahl-rostfrei.de [*Steel Leaflet* 821, "Corrosion-Resistant Stainless Steel—Information Source for the Properties of Stainless Steel," PF . . . ] and in P. ümpel et al. *Rostfreie Stähle [Rust-Resistant Steels*], Expert Publishing House, Volume 349, Renningen Malmsheim 1998.

Typical austenitic stainless steels are the steel alloys 1.4301 or 1.4571 with the following compositions:

1.4301: C 0.05; Si0.5; Mn 1.4; Cr 18.5; Ni 9.5 weight %.

1.4571: C 0.03; Si 0.5; Mn 1.7; Cr 17.0; Ni 11.2; Mo 2.2; Ti 0.1 weight %.

If the chromium content amounts to less than 13 weight %, the steel is generally not sufficiently corrosion-resistant to be considered "stainless steel." The metallic chromium content of the steel is thus an important criterion for the corrosion-resistance, as mentioned in particular in the aforementioned publication by P. Gümpel.

One great disadvantage of most of the commonly used stainless steel types, such as 1.4301, 1.4441, 1.4541 or 1.4575, is that these are relatively soft steels and that their surfaces can consequently be scratched by hard particles such as dust, sand and the like. Most types of stainless steel, apart from the so-called martensitic stain steels, cannot be hardened with the aid of physical processes such as annealing and chilling. The low surface hardness frequently stands in the way of a use of the stainless steel. A further disadvantage of most types of stainless steel is the strong tendency to corrosion seizing, meaning the fusing of two surfaces that slide against each other as a result of adhesion.

To counter this problem, it is known to subject work pieces made from stainless steel to a thermo-chemical treatment. During this treatment, the stainless steel surface is enriched with nitrogen through the process of nitrating or nitro-carbureting in a gas atmosphere (ammonia atmosphere), in plasma (nitrogen/argon atmosphere) or in the molten salt bath (using molten cyanates), wherein iron nitrides and chromium nitrides form. The resulting layers are formed from the material itself, meaning they are not deposited from the outside, in contrast to galvanic or physical layers, and therefore have extremely high adhesive strength. Depending on the length of treatment, hard layers form, which have a thickness ranging from 5 to 50 μm. The hardness of such nitrated or nitro-carbureted layers on stainless steel reaches values exceeding 1000 units on the Vickers Hardness Scale because of the high hardness of the resulting iron nitrides and chromium nitrides.

The problem with a practical use of such nitrated or nitro-carbureted layers on stainless steel is that these layers are hard, but also lose their corrosion resistance as a result of the relatively high treatment temperature, which is in the range of 580° C. during the nitrating or the nitro-carbureting process. At this temperature, the diffused-in elements nitrogen and carbon form stable chromium nitrides (CrN) and/or chromium carbides ($Cr_7C_3$) with the chromium in the surface region of the component. In this way, the free chromium that is absolutely necessary for the corrosion resistance is removed from the stainless steel matrix up to a depth of approximately 50 μm below the surface and is converted to chromium nitride or chromium carbide. The component surface becomes hard because of the forming of iron nitride or chromium nitride, but is also subject to corrosion. During the use of the work piece, these types of layers become quickly worn down and/or are eroded because of corrosion.

The following processes are known for avoiding this problem.

It is known that the surface hardness of stainless steel can be improved through depositing galvanic layers, e.g. through nickel-plating, or by depositing physical layers, e.g. with the aid of PVD coating (physical vapor deposition). In the process, however, a material foreign to the species is deposited on the steel surface. The surface in contact with the medium causing the wear or corrosion is no longer the steel surface itself. As a result, there are problems with the adherence and corrosion-resistance. These processes are therefore not widely used for improving the hardness and wear-resistance of stainless steel.

A hard and simultaneously corrosion-resistant layer can be generated thermo-chemically with the aid of the so-called kolsterizing on stainless steel. This process is mentioned, for example in "Kolsterisieren—korrosionsfestes Oberflächenhärten von austenitischem rostfreiem Stahl"—Informationsblatt der Bodycote Hardiff bv ["Kolsterizing—Corrosion-Resistant Surface Hardening of Austenitic Rust-Resistant Steel"—Information Leaflet by the company Bodycote Hardiff bv], Parimariboweg 45, NL-7333 Apeldoorn; at info@hardiff.de. However, the requirements for carrying out this process are not described in the patent literature or in the generally accessible scientific literature. Components treated with this process have a hard, wear-resistant layer with a thickness ranging from 10 to 35 μm while the corrosion-resistance of the basic material is retained. Kolsterized components cannot be heated above 400° C. since they otherwise lose their corrosion resistance.

With the aid of plasma nitrating, as described in H. J. Spies et al., *Mat. Wiss. u. Werkstofftechnik,* 30 (1999) 457-464" [H. J. Spies et al. *Material Knowledge and Material Technology,* 30] and in Y. Sun, T. Bell et al., "The Response of Austenitic Stainless Steels to Low Temperature Plasma Nitriding," *Heat Treatment of Metals,* 1999.1, p. 9-16, or with the aid of low-pressure carburizing at low temperatures, e.g. as is described in D. Günther, F. Hoffmann, M. Jung, P. Mayr: "Oberflächenhärtung von austenitischen Stählen unter Beibehaltung der Korrosionsbeständigkeit," *Härterei-Techn. Mitt.* 56 (2001) 74-83" [D. Gunther, F. Hoffmann, M. Jung, P. Mayr: "Surface Hardening of Austenitic Steels While Retaining the Corrosion Resistance," *Hardening Techn. Inform.,* 56 (2001) 74-83], it is possible to generate an over-saturated solution of nitrogen and/or carbon in the surfaces of stainless steel components, which has the desired properties, meaning the desired higher hardness with unchanged corrosion-resistance.

However, both processes require high apparatus expenditure and high investment and energy costs. Specially trained and in most cases even scientifically trained personnel are needed for operating the equipment.

SUMMARY OF THE INVENTION

It is therefore an object of the present invention to provide a process, which makes it possible to harden work pieces made of stainless steel while simultaneously achieving a high corrosion-resistance of the work pieces.

The above and other objects are achieved according to the invention wherein there is provided in one embodiment a method for hardening the surfaces of work pieces made of stainless steel, comprising: submerging the work pieces into a molten salt bath having the composition: potassium acetate 60-100 weight %, sodium acetate 0-100 weight %, metal salts 0-2 weight %; and subjecting the work pieces to the molten salt bath for a period of 24 hours to 240 hours while maintaining the temperature of the molten salt bath less than 400° C.

The above method avoids the forming of carbides in the steel matrix, which is the lattice structure of the stainless steel, since the treatment temperature for the work pieces, meaning the temperature of the molten salt bath used with the method according to the invention, is lower than the temperature at which chromium carbide forms and which is in the range of 420° C. to 440° C.

Since the forming of chromium carbides is for the most part avoided, it means that the free chromium that is absolutely necessary for the corrosion-resistance of the stainless steel work pieces is not removed from the surface region of the work pieces. As a result, the work pieces have hard, wear-resistant, easy to slide surfaces and simultaneously also high corrosion-resistance.

The use of the molten salt bath according to the invention is essential for achieving this advantageous effect. This molten salt bath contains components from which diffusible carbon can be released, as well as suitable activators that cause the release of the diffusible carbon at low temperatures.

The concentration of active, carbon-releasing materials (acetate or carbide which forms as intermediate stage) is very high in the molten salt bath according to the invention, as compared to the concentration of corresponding materials (ammonia, methane, carbon dioxide) in gaseous atmospheres or in plasma. The relatively long treatment periods for the work pieces in the molten salt bath are based on the fact that the diffusion speed of carbon is a function of the temperature and drops significantly at temperatures below 450° C. Long diffusion times ranging from 24 to 240 h must therefore be used for the low temperatures required to avoid the forming of chromium carbide. The resulting long treatment periods, however, are not critical since stainless steels, in particular austenitic, rust-free steels or the so-called compound steels (ferritic—austenitic steels) are very insensitive to such long thermal treatment periods. That is to say, they barely change their other mechanical characteristics or the structure.

Stainless steel is mostly present in the form of austenitic steel, meaning the iron matrix has the structure of austenite, a cubical and face-centered lattice such as is described in *Stahl Merkblatt* 821 "Edelstahl Rostfrei—Eigenschaften Informationsstelle Edelstahl," PF 102204, 40013 Düsseldorf, www.edelstahl-rostfrei.de" [*Steel Leaflet* 821 "Stainless Steel Rust-Free—Information Site for the Properties of Stainless Steel," PF . . . ] and in P. Gümpel et al., *Rostfreie Stähle*, Expert Verlag, Band 349, Renningen Malmsheim 1998" [P. Gümpel et al., *Stainless Steels*, Expert Publishing House, Volume 349, Renningen Malmsheim 1998].

In this lattice, a nonmetal element such as carbon can be present in a solid solution. If carbon is successfully introduced into the surface of an austenitic stainless steel and is present therein as a solid, saturated or even over-saturated solution, then the following two effects will occur:

(a) No carbides of the chromium will form if carbon is diffused-in below the temperature where chromium carbide forms (420-440° C.). Accordingly, chromium is not extracted from the alloy matrix in the region of the diffusion layer, and the corrosion-resistance of the stainless steel is retained.

(b) The diffused-in elements expand the austenitic lattice and lead to a strong compressive strain in the region of the diffusion zone which, in turn, leads to a considerable increase in the hardness. In scientific literature, this is referred to as expanded austenite or a so-called S-phase, which can have a hardness of up to 1000 on the Vickers Scale and is mentioned in "Y. Sun, T. Bell et al., "The Response of Austenitic Stainless Steel to Low Temperature Plasma Nitriding."

The present invention makes use of these considerations by utilizing a molten salt bath as reactive medium and heat transfer agent.

The basic melt is a salt mixture containing potassium acetate, sodium acetate and a metal salt. The acetate decomposes and forms free carbon as a result of the holding period at a fixed temperature, which in all cases is below 400° C. and thus below the temperature where chromium carbide forms and is preferably in the range between 320° C. and 380° C. The added metal salt can also cause a catalytic decomposition of the acetate to form a metal carbide which, in turn, decomposes at the existing temperature and releases "atomic" carbon to the stainless steel.

The present invention avoids the high apparatus and energy expenditure and utilizes an easy-to-use process, which can be realized even with less qualified personnel.

As a result of the invention, the tendency of stainless steel to corrosion seize, meaning the tendency to cold-welding and thus also the adhesive wear, are reduced considerably. The hardness of the stainless steel surface is increased from 200 to 300 Vickers to values of up to 1000 Vickers on the scale, thus resulting in a high scratch-resistance.

The metal salt is advantageously contained in the molten salt bath according to the invention with the cations and anions disclosed in claims 3 and 4.

According to one especially cost-effective and simple embodiment of the invention, the molten salt bath is operated in an atmosphere of ambient air. However, this has the disadvantage that oxidation processes cause an accelerated decomposition of the acetates in the molten salt bath because of the contact with the air, thereby reducing the degree of effectiveness for the treatment of the work pieces in the molten salt bath.

This disadvantage can be avoided if the molten salt bath is operated in a protective gas atmosphere, wherein the protective gases $N_2$, Ar, CO, $CO_2$ or mixtures of these gases are used. In that case, the acetates can only decompose under the effect of heat, but not as a result of the additional oxidation processes, meaning the rate of acetate decomposition is greatly reduced.

Creating a protective gas atmosphere requires a considerable structural expenditure since the molten salt bath must be stored inside a retort into which the protective gas must be introduced. The introduction of the protective gas must furthermore be repeated each time the retort is opened.

The acetate decomposition can also be reduced with less structural expenditure by introducing or feeding the protective gases into the molten salt bath, thereby simultaneously resulting in a recirculation of the molten salt bath, which leads to a uniform distribution of the salts in the molten salt bath. In general, a recirculation is achieved by feeding ambient air into the molten salt bath.

Alternatively, the molten salt bath can also be moved mechanically, for example by stirring or circulating.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

These and other features and advantages of the invention will be further understood from the following detailed description of the preferred embodiments with reference to the accompanying drawings, showing in.

DETAILED DESCRIPTION OF THE PREFERRED EMBODIMENTS

The following examples show the results of treating the same work piece, namely a bolt composed of the material X5 Cr Ni Mo 17-12-2, with two different variants of the molten salt bath according to the invention.

Example 1

Figure 1:
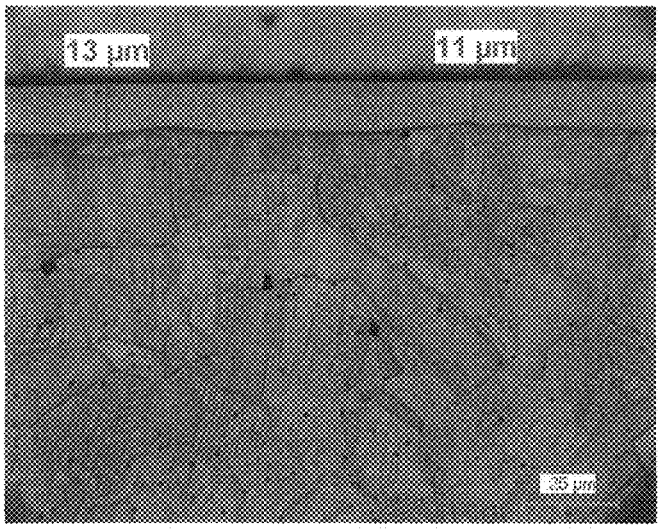
FIG. 1 A transverse cross section of a work piece treated with a first molten salt bath.
Figure 2:
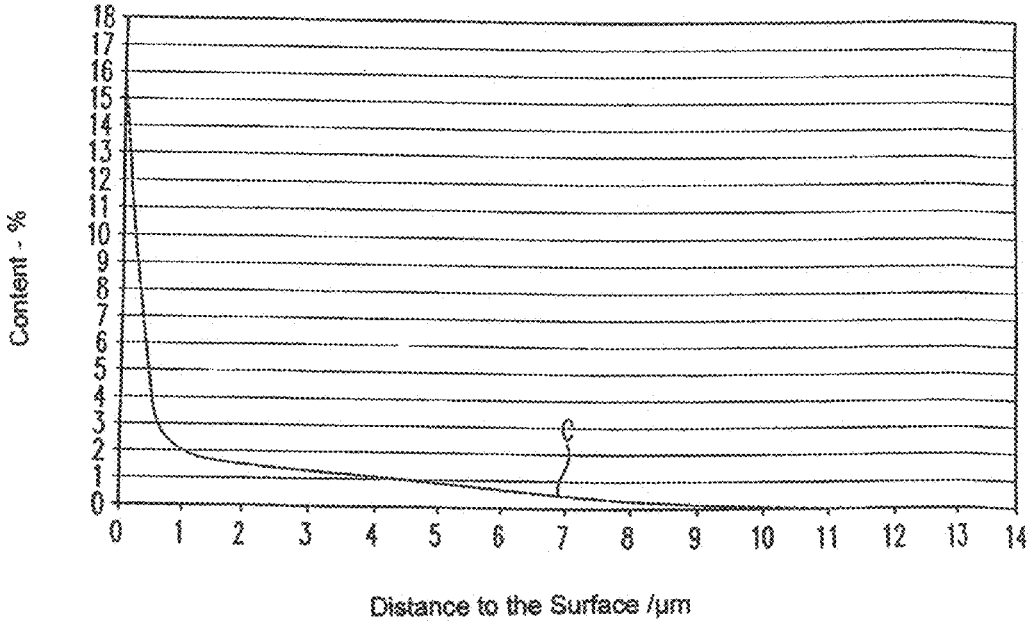
FIG. 2 Location-dependent course of the carbon concentration in the surface area of the work piece according to FIG. 1.

A mixture composed of 120 g potassium acetate and 0.2 g $NiCl_2$ is melted in a crucible and at 380° C., a bolt (material: X5 Cr Ni Mo 17-12-2) is submerged into the mixture for a period of 53.5 hours. Following the treatment, the bolt is rapidly cooled in water. Layers with a thickness of 11 μm to 13 μm form. The GDOS (glow discharge optical emission) analysis according to FIG. 2 shows a clear increase in carbon (up to 16%) in this layer (FIG. 2 shows the carbon content in % by weight in dependence on the distance from the surface of the work piece). FIG. 1 shows a transverse cross section of the work piece (bolt) in the region of this layer.

Example 2

Figure 3:
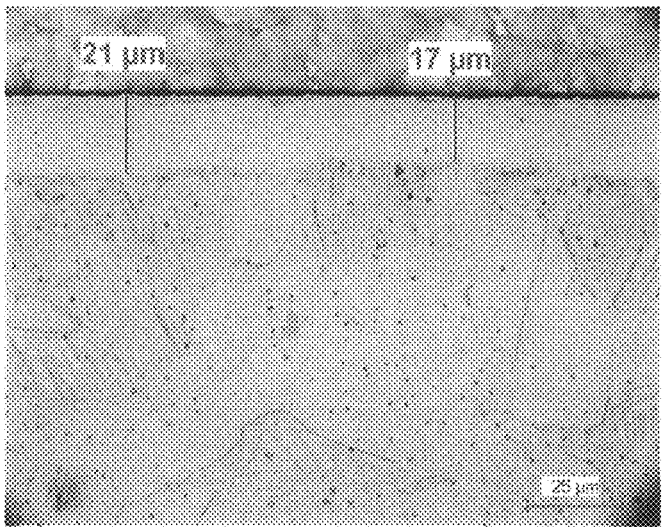
FIG. 3 A transverse cross section of a work piece treated in a second molten salt bath.
Figure 4:
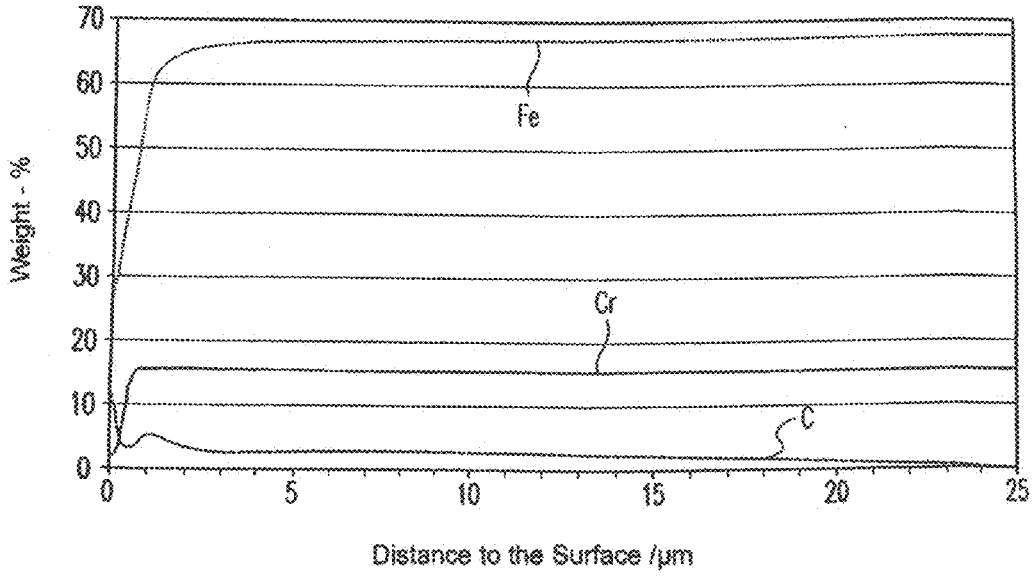
FIG. 4 Location-dependent course of the concentrations of Fe, Cr, C in the surface area of the work piece according to FIG. 3.

A mixture of 120 g potassium acetate and 0.2 g $NiCl_2$ is melted in a crucible and at 380° C., a bolt (material: X5 Cr Ni Mo 17-12-2) is submerged in the mixture for a period of 100 hours. Following the treatment, the bolt is cooled rapidly in water. Layers with a thickness of 17 μm to 21 μm form. FIG. 4 shows the concentration of Fe, C, Cr in the work piece in % of weight, in dependence on the distance from the surface of the work piece. FIG. 4 again shows a clear increase in carbon in the layer while the share of Cr, Fe in the layer is reduced. FIG. 3 contains a transverse cross section of a work piece (bolt) in the region of this layer.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for hardening the surfaces of work pieces made of stainless steel, comprising:

submerging the work pieces into a molten salt bath having the composition:

| | |
|---|---|
| potassium acetate | 60-100 weight % |
| sodium acetate | 0-40 weight % |
| metal salts | 0-2 weight %; and |

subjecting the work pieces to the molten salt bath for a period of 24 hours to 240 hours, while maintaining the temperature of the molten salt bath less than 400° C.

2. The method according to claim 1, including maintaining the temperature of the molten salt bath in the range of 330° C. to 380° C.

3. The method according to claim 1, wherein the metal salt used includes at least one of the following cations:

$Li^+$, $Na^+$, $K^+$, $Cs^+$, $Mg^{2+}$, $Ca^{2+}$, $Sr^{2+}$, $Ba^{2+}$, $Ti^{3+/4+}$, $V^{2+/3+/4+/5+}$, $Cr^{2+/3+}$, $Mn^{2+/4+}$, $Fe^{2+/3+}$, $Co^{2+/3+}$, $Ni^{2+/3+}$, $Cu^{+/2+}$, $Zn^{2+}$, $Mo^{4+/5+/6+}$, $Ru^{2+/3+}$, $Rh^{1+/3+}$, $Pd^{2+}$, $W^{6+}$, $Os^{4+}$, $Ir^{+/4+}$.

4. The method according to one claim 1, wherein the metal salt includes at least one of the following anions: $F^-$, $Cl^-$, $Br^-$, $I^-$, $O^{2-}$, $CH_3COO^-$, $C_2O_4^{2-}$, $CN^-$, $NCO^-$.

5. The method according to claim 1, including operating the molten salt bath in an atmosphere with ambient air.

6. The method according to claim 1, including operating the molten salt bath in a protective gas atmosphere.

7. The method according to claim 1, including conducting the ambient air or a protective gas through the molten salt bath.

8. The method according to claim 6, wherein the protective gas is at least one of gas $N_2$, Ar, CO, or $CO_2$.

9. The method according to claim 1, covering the molten salt bath with a carbon-containing powder or granular material.

10. The method according to claim 1, including agitating the molten salt bath.

11. The method according to claim 10, characterized in that the molten salt bath is stirred or circulated.

* * * * *